US006820423B1

(12) United States Patent
Linney et al.

(10) Patent No.: US 6,820,423 B1
(45) **Date of Patent: *Nov. 23, 2004**

(54) METHOD FOR IMPROVING POWER PLANT THERMAL EFFICIENCY

(75) Inventors: Jonathan W. Linney, Kingwood, TX (US); Michael B. Bibb, Kingwood, TX (US); Timothy Ray Bauer, Kingwood, TX (US)

(73) Assignee: Johnathan W. Linney, Kingwood, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/654,096

(22) Filed: Sep. 3, 2003

Related U.S. Application Data

(63) Continuation-in-part of application No. 10/413,767, filed on Apr. 15, 2000.

(51) Int. Cl.[7] ..... F01K 25/08
(52) U.S. Cl. ..... 60/651; 60/671; 60/676
(58) Field of Search ..... 60/651, 671, 676, 60/679, 653

(56) References Cited

U.S. PATENT DOCUMENTS 4,428,201 A * 1/1984 Carson ..... 60/648
4,429,536 A * 2/1984 Nozawa ..... 60/655
4,953,479 A * 9/1990 Keller et al. ..... 110/233
5,161,377 A * 11/1992 Muller et al. ..... 60/653
5,799,626 A * 9/1998 Ponsford et al. ..... 123/41.42

* cited by examiner

*Primary Examiner*—Hoang Nguyen
(74) *Attorney, Agent, or Firm*—Wendy Buskop; Buskop Law Group, P.C.

(57) ABSTRACT

Embodiments of the invention include a method for retrofitting a power plant that reduces the consumption of fossil fuel using compressed heated air by retrofitting the power plant by adding at least three heat exchangers, a vessel, a pump, and a control system to the power plant, wherein the first heat exchanger receives compressed heated air from a power source and produces heated heat exchange fluid and a second heat exchanger heats a hydrocarbon flow that drives a turbine coupled to a generator in the power plant, wherein the generator produces power and exhaust gases, wherein the method entails pumping a heat exchange fluid through a first heat exchanger; exchanging heat with compressed heated air; splitting heated fluid flow into a second heat exchanger and a vessel; flowing the heated fluid through a second heat exchanger exchanging heat with a hydrocarbon flow; flowing the heated fluid from the vessel to a third heat exchanger; and using the vessel to accommodate fluid thermal expansion.

30 Claims, 6 Drawing Sheets

METHOD FOR IMPROVING POWER PLANT THERMAL EFFICIENCY

CROSS-REFERENCE TO RELATED APPLICATIONS

This application is a continuation in part of U.S. patent application Ser. No. 10/413,767, filed Apr. 15, 2003.

FIELD

Embodiments of this invention relate to a method for retrofitting a power plant to reduce the consumption of fossil fuel by the power plant using a plurality of heat exchangers, a vessel, a pump, and a heat exchange fluid recycle system.

BACKGROUND

A need has existed for lower cost, fuel efficient power plants. This need has been driven by the high cost of energy.

The present invention is directed to a method which utilizes existing power plant equipment and adds three heat exchangers connected in a unique configuration with a pump and a vessel to an existing heated air stream or hot exhaust gas stream to raise the temperature of a fuel flow or a hydrocarbon stream by at least 50% to up to 900% prior to directing the fuel flow to a turbine to drive a generator.

SUMMARY

The invention relates to a method for retrofitting a power plant that reduces the consumption of fossil fuel using compressed heated air by retrofitting the power plant by adding at least three heat exchangers, a vessel, a pump, and control system to the power plant. The first heat exchanger receives compressed heated air from a power source and produces heated heat exchange fluid. The second heat exchanger heats a hydrocarbon flow that drives a turbine coupled to a generator in the power plant, wherein the generator produces power and exhaust gases.

The method entails pumping a heat exchange fluid through the set of tubes in the first heat exchanger; increasing the heat exchange fluid temperature and cooling the compressed heated air; and splitting the heated fluid flow into a second heat exchanger and a vessel. The method continues by injecting a hydrocarbon flow into the set of tubes in the second heat exchanger and flowing the heated fluid into the second heat exchanger transferring heat from the heated heat exchange fluid to the hydrocarbon flow whose temperature increases between 90% and 500%. The method further includes flowing the cooled heat exchange fluid to the vessel; flowing at least a portion of the heated fluid from the vessel to a third heat exchanger and cooling the excess heated heat exchange fluid; and using the vessel to accommodate thermal expansion of the fluid.

BRIEF DESCRIPTION OF THE FIGURES

The present invention will be explained in greater detail with reference to the appended Figures, in which.

Figure 1:
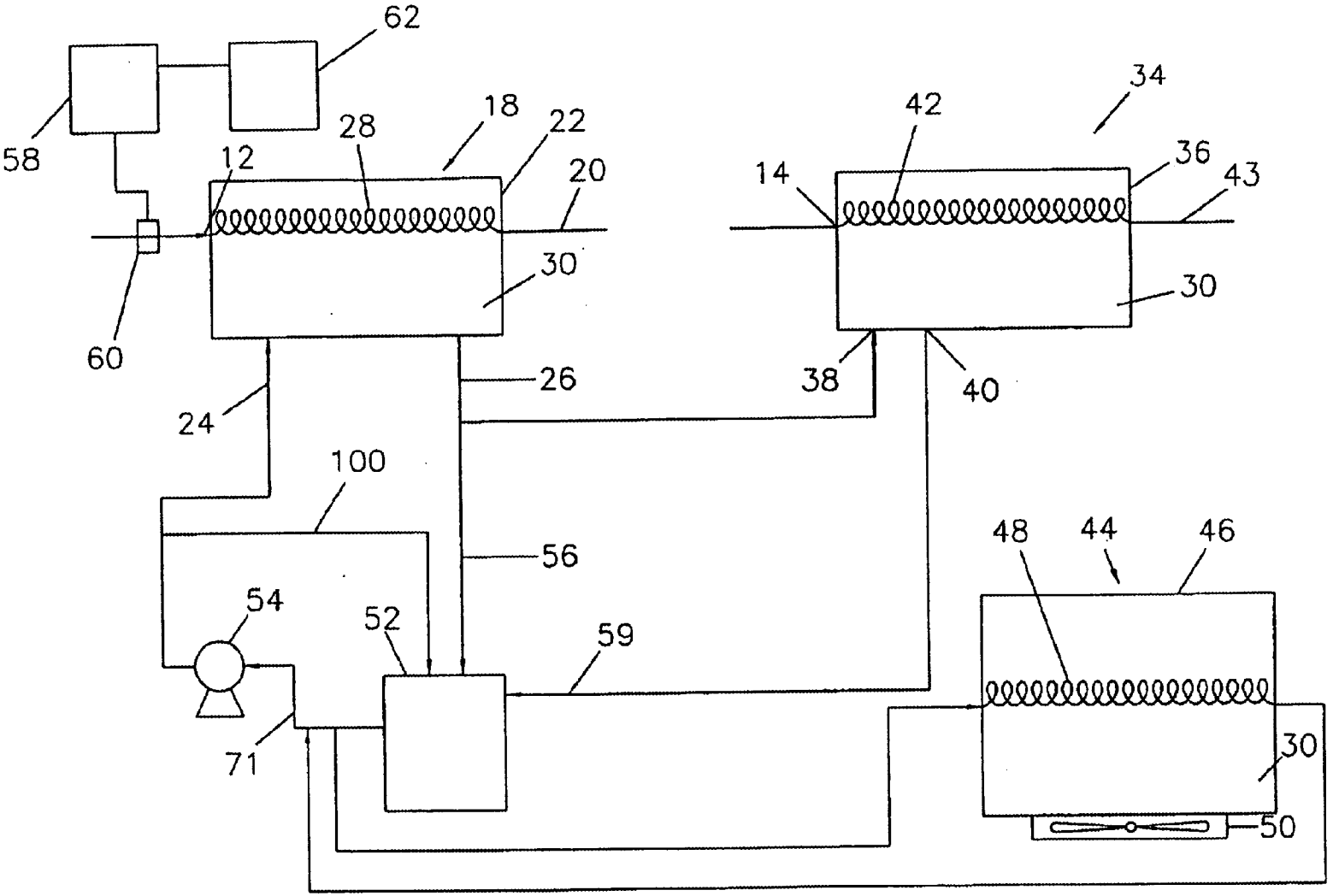
FIG. 1 is an overview of the system for use in the power plant.

The present invention is detailed below with reference to the listed Figures.

DETAILED DESCRIPTION

Before explaining the present invention in detail, it is to be understood that the invention is not limited to the particular embodiments herein and it can be practiced or carried out in various ways.

Embodiments of the invention include a method for operating a heat exchanger in a power plant.

In one embodiment, the method includes retrofitting a power plant to reduce the consumption of fossil fuel using compressed heated air.

The method generally includes retrofitting the power plant by adding at least three heat exchangers, a vessel, a pump, and a control system to the power plant wherein a first heat exchanger receives compressed heated air from a power source and produces heated heat exchange fluid; supplying heated heat exchange fluid to a second heat exchanger that heats a hydrocarbon flow for the power plant that drives a turbine coupled to a generator and produces power and additional hot exhaust gases; pumping a heat exchange fluid through a first heat exchanger around a first set of tubes containing the compressed heated air in the first set of tubes forming heated heat exchange fluid; removing compressed cooled air from the first set of tubes in the first heat exchanger; removing the heated heat exchange fluid from the first heat exchanger, passing at least a first portion the heated heat exchange fluid to a second heat exchanger, a second portion of the heated heat exchange fluid from the first heat exchanger to a vessel; injecting a hydrocarbon flow into a second set of tubes in the second heat exchanger and flowing the heated heat exchange fluid into the second heat exchanger around the second set of tubes transferring heat from the heated heat exchange fluid to the hydrocarbon flow forming a heated hydrocarbon flow and a cooled heat exchange fluid, and wherein the second heat exchanger increases the hydrocarbon flow temperature between 50% and 900%, then discharging the heated hydrocarbon flow to a hydrocarbon flow outlet, and flowing the cooled heat exchange fluid to the vessel; using the vessel to accommodate thermal expansion of the fluid from the first heat exchanger, the second heat exchanger, or combinations thereof; passing at least a portion of the heat exchange fluid from the vessel to a third heat exchanger and from the third heat exchanger to a pump; and pumping the cooled heat exchange fluid from the vessel to the first heat exchanger, wherein at least a portion of the cooled heat exchange fluid passing from the vessel to the first heat exchanger flows through a conduit and back to the vessel.

In an alternative method, the method can include the step of using a control panel, at least one sensor, and a central processing unit in communication with the control panel and sensor to monitor and compare the pressurized heat exchange fluid in to a preset value.

The invention relates to a system for heating hydrocarbon flows using heated compressed air, such as from a compressor exhaust for from compressed air available at a power plant.

As the need for higher efficient power plants increases, there is a need for improving the performance of gas fuel heating to improve overall plant efficiency. By essentially preheating the fuel, such as fuel gas to a range of 365 degrees F., gas turbine efficiency is improved by reducing the amount of fuel needed to achieve the desired firing temperatures. Fuel heating is viable and the present invention is directed to a method for fuel heating to improve the plant efficiencies and recycle the heat exchange fluid through a series of heat exchangers.

FIG. 1 shows an overview of the system.

Figure 2:
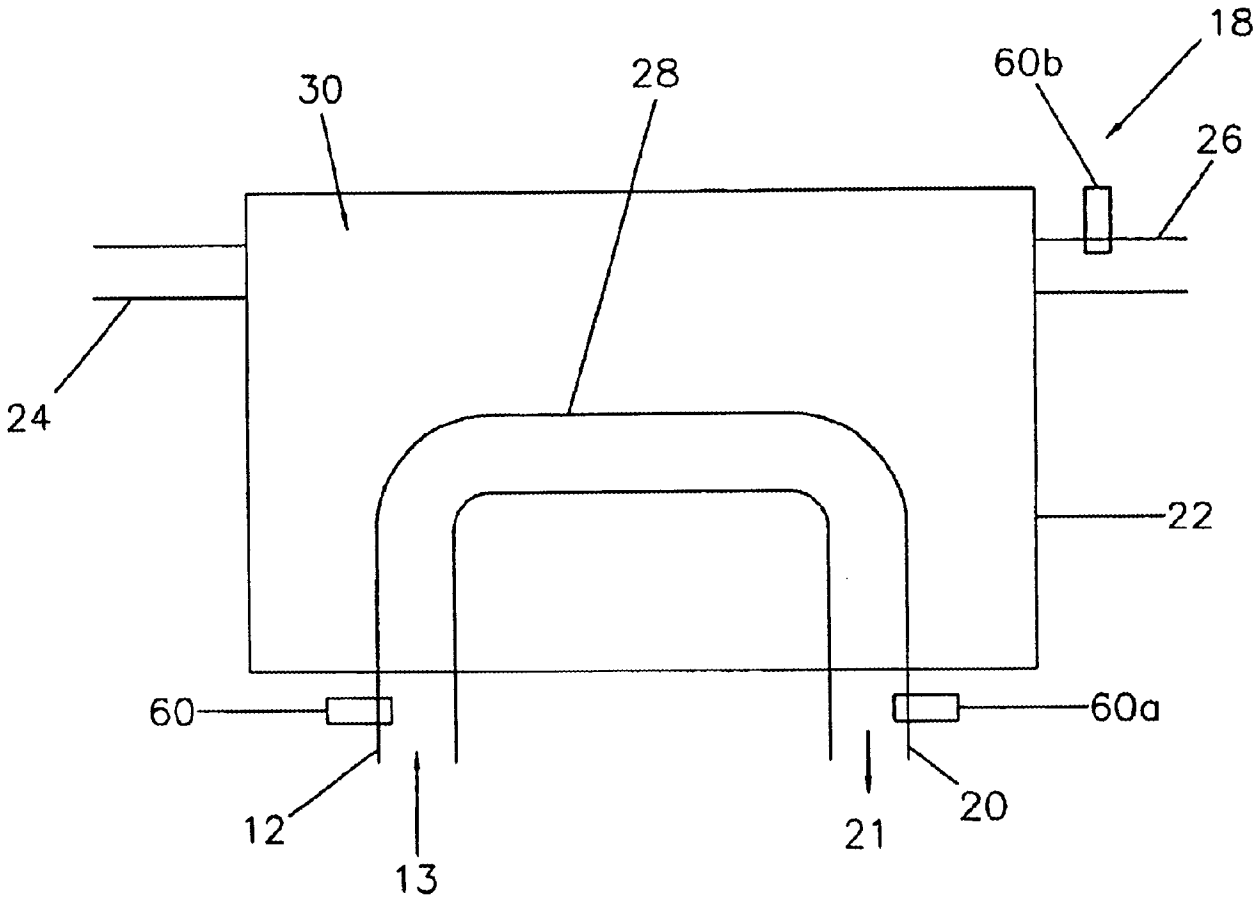
FIG. 2 is a detailed view of the first heat exchanger.

FIG. 1 and FIG. 2 show the first heat exchanger (18) having a housing (22). A detail of this heat exchanger is also shown in FIG. 2. A compressed heated air inlet (12) is disposed in the housing (22). A compressed cooled air outlet (20) is disposed in the housing (22). The housing is preferably of welded construction from steel, and in a high temperature application, would be between ⅛ and ½ inch in thickness. In a preferred embodiment, the compressed heated air inlet has a nominal diameter between 8 inches and 14 inches. The compressed cooled air outlet preferably has the same dimension as the compressed heated air inlet, but they could vary depending on actual location of the housing in the heat exchanger and proximity to other equipment.

The housing (22) further has a first housing inlet (24) disposed in the housing, such as in the wall, and a first housing outlet (26) disposed in the housing (22), such as in the wall of the housing (22). The first housing inlet (24) and first housing outlet (26) can be about 6 inches nominal diameter but can range from 3 inches to 12 inches and still be usable in the invention.

The first heat exchanger (18) removes heat from the compressed heated air and increases the temperature of the pressurized heat exchange fluid. On start up of the system, the pressurized heat exchange fluid will change its temperature from an ambient temperature to about 750 degrees F. This activity reduces the temperature of the compressed heated air from 25% to 85%.

Sensors are preferably disposed at each inlet and outlet in the housing, such as a thermal transducer (60), a pressure sensor **(60*a*), and a thermocouple (60*b*) that are used to monitor temperature and pressure in and out of the housing (22), as shown in FIG. 2**. The sensors can include commercially available sensors, such as those from Fisher Rosemount of Illinois.

A first set of tubes (28) is contained within the housing. One end of the first set of tubes is for receiving compressed heated air (13) through the compressed heated air inlet (12). The other end of the first set of tubes is for communicating the compressed heated air (27) out of the first heat exchanger via the compressed cooled air outlet (20). In a preferred embodiment the tubes are constructed from steel, which could be coated. Alternatively, the steel could be a carbon/steel alloy such as the tubes available from Triad Measurement of Humble, Tex. The tubes can vary from about ¼ inch nominal diameter to about 3 inches. The tubes as utilized are coiled. Multiple small tubes could be connected together in series, but it is possible that the air inlet could split into a plurality of tubes. An acceptable overall length of the first set of tubes to hold the air could be between 10 feet and 60 feet. The compressed cooled air flows out of the outlet (20).

A pressurized heat exchange fluid (30) is contained within the first housing and is in fluid communication with the first housing inlet (24) and the first housing outlet (26) and the fluid circulates around the first set of tubes (28). The first heat exchanger transfers heat from the compressed heated air (13) in the first set of tubes to the pressurized heat exchange fluid (30). The invention contemplates that the heat exchange fluid is mineral oil or a glycol. Other examples of usable heat exchange fluids include synthetic oil, a silicon based fluid or a fluid that is a mixture of a terphenyl, a quarterphenyl and a phenanthrene, such as available from Solutia, Inc. known as Therminol® 75 heat transfer fluid of St. Louis, Mo.

Figure 3:
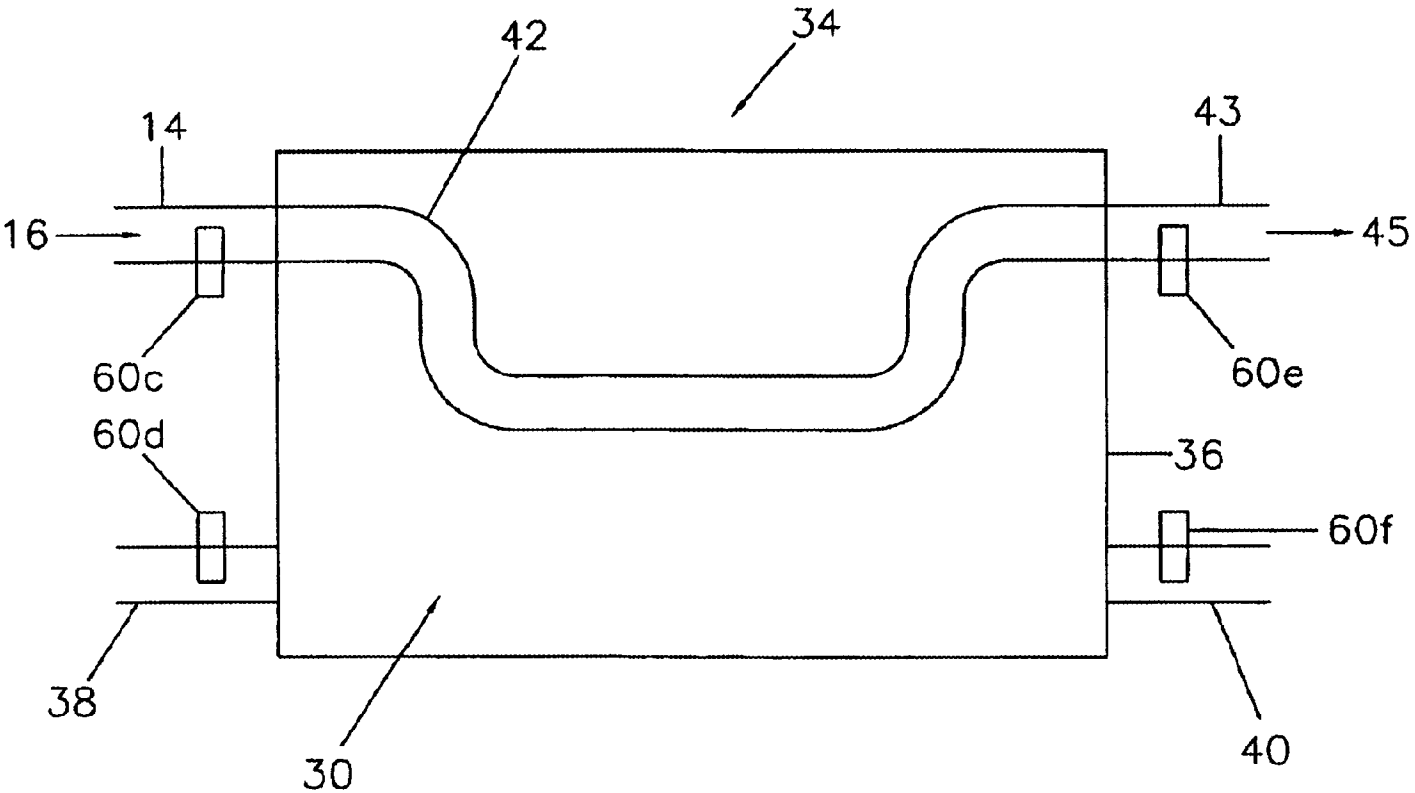
FIG. 3 is a detailed view of the second heat exchanger.

Connected to this first heat exchanger is a second heat exchanger (34). FIG. 3 shows a detail of this second heat exchanger (34).

The second heat exchanger (34) has a second housing (36) and a hydrocarbon flow inlet (14) disposed in the wall of that second housing (36). The hydrocarbon flow inlet (14) preferably has an 8 inch nominal diameter, but can range from 3 inches to 12 inches. A second housing inlet (38) for receiving the pressurized heat exchange fluid from the first heat exchanger is also disposed in the second housing. Preferably, this second housing inlet (38) that received the heat exchange fluid would be 3 inches to 12 inches nominal diameter and preferably a 6 inch nominal diameter. Additionally, a second housing outlet (40) is disposed in the second housing. The second housing outlet (40) would preferably have the same dimensions as the second housing inlet. A heated hydrocarbon flow outlet (43) is disposed in the second housing. The hydrocarbon flow outlet (43) is preferably the same size as the hydrocarbon flow inlet (14). It would be preferred to exactly match the hydrocarbon inlet and outlet to prevent any pressure differentials in the flow. In a retrofit application, it is preferred to use identical inlets and outlets so there is no need for transition piping, or fittings which would affect the flow. Additional sensor **(60*c*, 60*d*, 60*e*, and 60*f*) can be used at each inlet and outlet, respectively, as shown in FIG. 3**.

As shown in FIG. 3 in particular, a second set of tubes (42) is disposed within the second housing (36) and is connected to the hydrocarbon flow inlet (14) for receiving the hydrocarbon flow (16) and communicating with the heated hydrocarbon flow outlet (43). The second set of tubes preferably has a nominal diameter of between ¼ inch and 3 inches. The preferred embodiment has the tubes as coiled tubing. However, multiple small tubes could be used wherein the multiple small tubes are connected together in series. It is possible that the hydrocarbon flow inlet could be split into a plurality of tubes at the inlet itself. An acceptable overall length of the second set of tubes to hold the hydrocarbon flow could be between 10 feet and 60 feet.

The second heat exchanger (34) acts to transfer heat from the pressurized heat exchange fluid (30) to the hydrocarbon flow (16) forming a heated hydrocarbon flow (45). In the most preferred embodiment, the heat exchange rate will preferably operate at between 8 million btu per hour and 25 million btu per hour. For example, one system utilizing the second heat exchanger has the second heat exchanger operating at 16.37 million btu per hour.

The heated hydrocarbon flow (45) moves from the second heat exchanger (34) through the heated hydrocarbon flow outlet (43). The second heat exchanger increases the hydrocarbon flow temperature at least 50% for combustion and in some cases increases the temperature up to 900%. A preferred temperate range for the hydrocarbon flow would be from an inlet temperature between 40 degrees F. and 50 degrees F. to an outlet temperature between 350 degrees F. and 400 degrees F. Sensors for temperature and pressure, such as in the first heat exchanger would be disposed in the inlets and outlets for monitoring and managing the pressure and temperatures of the heat exchange fluid and the hydrocarbon flow.

FIG. 1 further shows that a vessel (52) is in communication with the second heat exchanger (34), and optionally in communication with the first heat exchanger (18). A line (56) can be used in communication between the first heat exchanger and the vessel (52). In the most preferred embodiment, the line (56) from the first heat exchanger and the line from the second heat exchanger (59) are joined prior to entering the vessel (52).

The vessel (52) is adapted to accommodate thermal expansion of the pressurized heat exchange fluid (30). The vessel is typically carbon steel, or metal alloy, or plastic, a laminate, or graphite composite construction, but the vessel is capable of sustaining a pressure of at least 15 psia and up to at least 300 psia such as those available from Triad Measurement of Humble, Tex. Optionally, the vessel can comprise a heater (not shown) to prevent "gumming" up of the fluid in the vessel and in the adjacent flowlines.

A third heat exchanger (44) is connected to the vessel (52) and a pump (54).

Figure 4:
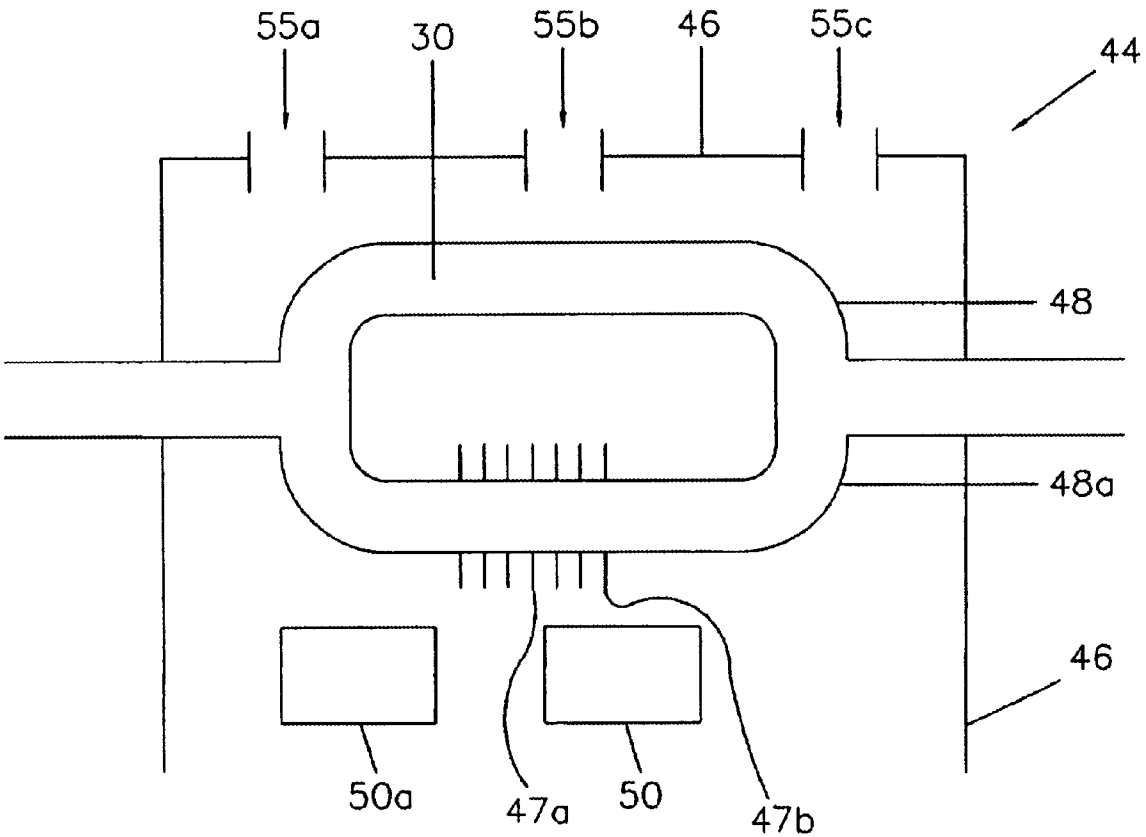
FIG. 4 is a detailed view of the third heat exchanger.

The third heat exchanger (44) is shown in more detail in FIG. 4. The third heat exchanger (44) has a third heat exchanger housing (46), at least one tube (48) disposed in the third heat exchanger housing for receiving the pressurized heat exchange fluid (30) from the vessel (52) and communicating the pressurized heat exchange fluid (30) then through the pump (54) and, then, to the first housing inlet (24) of the first heat exchanger (18). At least a portion of the heat exchange fluid (30) can be recycled from the pump (54) to the vessel (52) via conduit 100. In the preferred embodiment, the third heat exchanger housing is of welded steel or steel alloys and is of a construction that is open on at least one side and includes evacuation openings (55*a*, 55*b*, and 55*c*), as shown in FIG. 4. However, it is also optionally contemplated that the housing of the third heat exchanger could be a contained system. In the most preferred embodiments, it is contemplated that the first and second heat exchangers are of a shell, or closed container configuration.

The at least one tube of the third heat exchanger can range in nominal diameter from ¼ inch to 2 inches. However, other nominal diameters can be used depending on the size of the inlet and outlet for the third heat exchanger.

The tube (48) can be a plurality of tubes (48 and 48*a*) within the housing of the third heat exchanger (44) with optional fins (47*a* and 47*b*) disposed on the tube(s) for exchanging heat more quickly and cooling the heat exchange fluid.

At least one fan (50) is disposed proximate the third heat exchanger housing (46) to cool the pressurized heat exchange fluid in the at least one tube. More than one fan (50, 50*a*) can be included, as shown in FIG. 4 and used to cool the tubes containing fluid. A fan, such as an electric motor driven fan, such as 1000 rpm to 4000 rpm fan with direct drive and alloy or polymer blades for directing air, would work within the scope of this invention.

FIG. 1 also shows that at least one pump (54) is used in this system. This pump is in communication with the outlet and/or the inlet of the vessel (52), the inlet of the first heat exchanger (18), and/or the outlet of the third heat exchanger (44) for transporting fluid through the line (71). The at least one pump can be a centrifugal pump such as a pump manufactured by Goulds Inc. A preferred pump is an electric driven, 40 hp pump with a flow rate of 400 gal/minute.

In the most preferred embodiment, the system further includes a control panel (58) and at least one sensor (60), and a central processing unit (62) to monitor and direct the pressurized heat exchange fluid in comparison to preset limits, as shown in FIG. 1. The control panel will have conventional gauges, and monitoring displays to show sensor data. The sensors will be conventional pressure and temperature sensors, such as those available from Fisher-Rosemont. The central processing unit is preferably a computer with compiler for processing the sensor data and presenting it on the control panel.

The hydrocarbon flow of this invention is contemplated to be oil, natural gas, methane, propane, or combinations of these hydrocarbons.

It should be noted that the hydrocarbon flow inlet receives the hydrocarbon flows source at a rate of between 10 and 40 ft/lbs per second, preferably at a rate of 30 ft/lbs per second.

It is also contemplated that this system could be used to control NoX emissions from a power plant, combustion source, engine or similar source.

Figure 5:
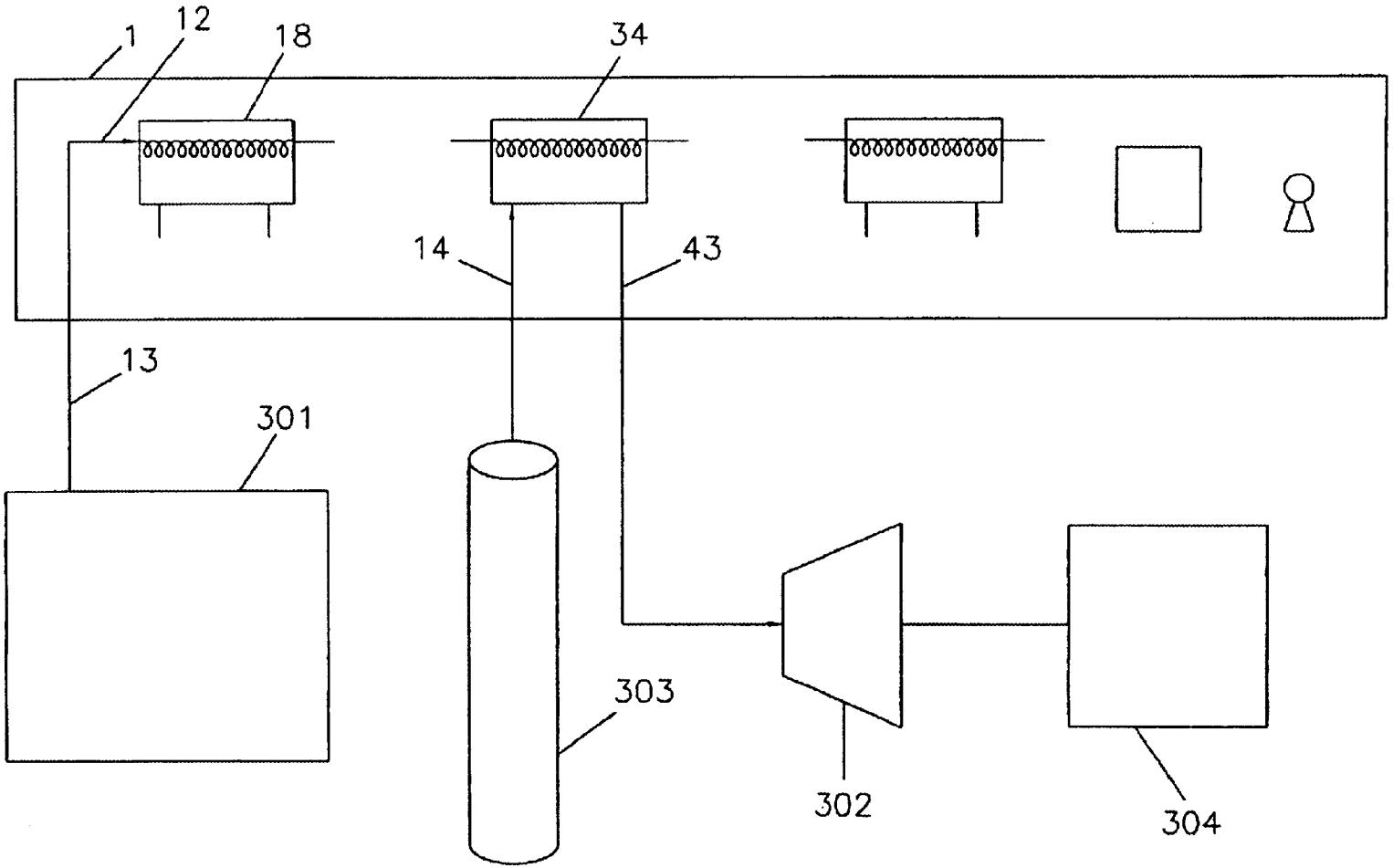
FIG. 5 is an overview of the power plant embodiment of the invention.

FIG. 5 shows an overview of the invention in a power plant. The three heat exchange system with vessel and pump is connected to a power source 301 in the power plant 300.

It is contemplated that power plants such as simple cycle, combined cycle can be retrofitted by this method. For example, power plants available from Siemens such as FD2 gas turbines or a General Electric steam turbine would be usable within the scope of the invention.

The power source 301 can be is a turbine, a turbine rotor, a compressor, a main exhaust stack of the power source, or combinations thereof. The turbine rotor exhaust can be from a combustion turbine or a gas turbine. The power source 301 sends its heated exhaust gas or compressed heated air (13) to the first heat exchanger (18) through the inlet (12).

The second heat exchanger (34) has a hydrocarbon flow inlet (14) that engages a pipeline (303). The pipeline (303) can contain oil or natural gas. The most preferred embodiment contemplates a natural gas pipeline. The pipeline (303) could be a fuel tank, or other fuel storage device.

The second heat exchanger (34) has a hydrocarbon flow outlet (43) which permits heated hydrocarbon flow (45) to communicate with a turbine (302). The most preferred turbine contemplated for use with the invention is a simple cycle gas turbine. The gas turbine can drive one generator (304). However, the invention contemplates that a plurality of gas turbines can drive an equal number of generators and be usable in the method of the invention.

Generators that can be used within the scope of the invention include 70 to 90 megawatt per hour generators, 130–150 Megawatt generators, and 180–200 Megawatt generators such as those available from General Electric, Mitsubishi, Siemens, Solar Turbines and similar manufacturers.

It is also contemplated that this method could be used to retrofit a power plant to control NoX emissions from that power plant.

Figure 6:
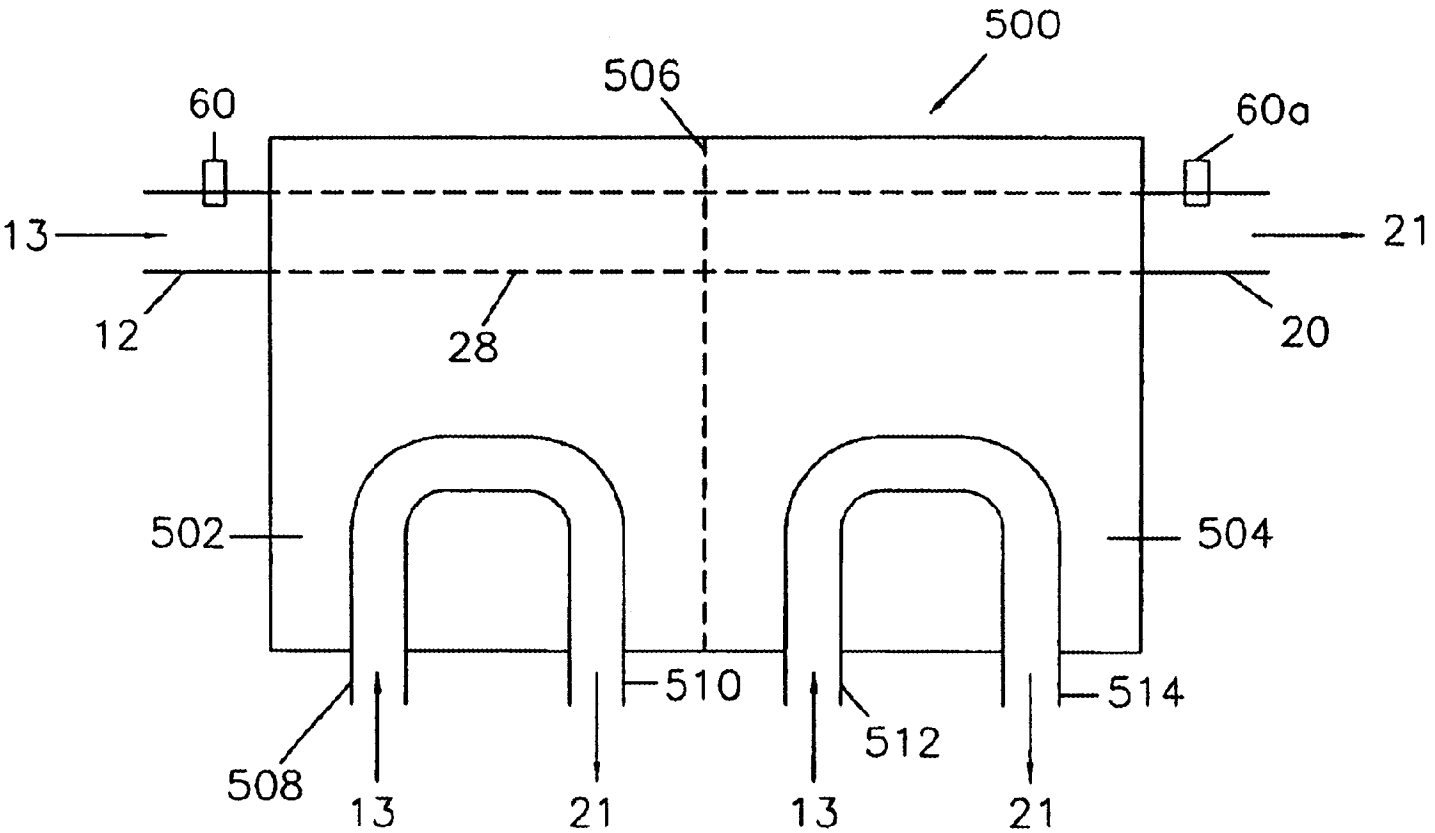
FIG. 6 is a detailed view of an alternative first heat exchanger.

FIG. 6 illustrates an alternative first heat exchanger than can be used in embodiments of the invention. The first heat exchanger (500) varies from the first heat exchanger (18) in that the first heat exchanger (500) includes a first compartment (502) and a second compartment (504). The first compartment (502) and the second compartment (504) can be separated by a baffle (506) or by any other means known to one skilled in the art. Both the first compartment (502) and the second compartment (504) include an inlet (508, 512) and an outlet (510, 514). Prior to entering the first heat exchanger (500), the heat exchange fluid can be split so that at least a portion of the heat exchange fluid is flowing through each compartment of the first heat exchanger (500).

Alternatively, the first heat exchanger (500) can be formed of two or more heat exchangers in series.

While this invention has been described with emphasis on the preferred embodiments, it should be understood that within the scope of the appended claims the invention might be practiced other than as specifically described herein.

What is claimed is:

1. A method for retrofitting a power plant that reduces the consumption of fossil fuel using compressed heated air comprising:

a. retrofitting the power plant by adding at least three heat exchangers, a vessel, a pump, and a control system to the power plant, wherein a first heat exchanger receives compressed heated air from a power source and produces heated heat exchange fluid;

b. supplying heated heat exchange fluid to a second heat exchanger that heats a hydrocarbon flow for the power plant that drives a turbine coupled to a generator and produces power and additional hot exhaust gases;

c. pumping a heat exchange fluid through a first heat exchanger around a first set of tubes containing the compressed heated air in the first set of tubes forming heated heat exchange fluid;

d. removing compressed cooled air from the first set of tubes in the first heat exchanger;

e. removing the heated heat exchange fluid from the first heat exchanger, passing at least a first portion of the heated heat exchange fluid from the first heat exchanger to a second heat exchanger, and a second portion of the heated heat exchange fluid from the first heat exchanger to a vessel;

f. injecting a hydrocarbon flow into a second set of tubes in the second heat exchanger and flowing the heated heat exchange fluid into the second heat exchanger around the second set of tubes transferring heat from the heated heat exchange fluid to the hydrocarbon flow forming a heated hydrocarbon flow and a cooled heat exchange fluid, and wherein the second heat exchanger increases the hydrocarbon flow temperature between 50% and 900%, then discharging the heated hydrocarbon flow to a hydrocarbon flow outlet, and flowing the cooled heat exchange fluid to the vessel;

g. using the vessel to accommodate thermal expansion of the fluid from the first heat exchanger, the second heat exchanger, or combinations thereof;

h. passing at least a portion of the heat exchange fluid from the vessel to a third heat exchanger and from the third heat exchanger to a pump; and i. pumping the cooled heat exchange fluid from the vessel to the first heat exchanger, wherein at least a portion of the cooled heat exchange fluid passing from the vessel to the first heat exchanger flows through a conduit and back to the vessel.

2. The method of claim 1, wherein the turbine is a gas turbine, or a combustion turbine.

3. The method of claim 1, wherein the power source is a turbine, a turbine rotor, a compressor, a main exhaust stack of the power source, or combinations thereof.

4. The method of claim 1, wherein the compressed heated air is injected at a pressure between 80 psia and 300 psia.

5. The method of claim 1, wherein the compressed heated air is injected at a pressure between 89 psia and 270 psia.

6. The method of claim 1, wherein the compressed cool air is removed from the first heat exchanger at a pressure between 80 psia and 300 psia.

7. The method of claim 1, wherein the cooling in the first heat exchanger occurs at a temperature between 300 degrees F. and 500 degrees F.

8. The method of claim 1, comprising the step of using a fin/fan heat exchanger as the third heat exchanger.

9. The method of claim 1, wherein the cooling in the third heat exchanger is by a fan that cools the pressurized heat exchange fluid by up to 95%.

10. The method of claim 1, wherein the step of flowing the hydrocarbon flow is by flowing a member consisting of the group oil, natural gas, methane, propane, and combinations thereof.

11. The method of claim 10, further wherein step of flowing the hydrocarbon flow is at a rate between 10 ft/lbs per second and 40 ft/lbs per second.

12. The method of claim 1, wherein the step of using a vessel involves using a vessel adapted to sustain a pressured heat exchange fluid between 15 psia and 300 psia.

13. The method of claim 1, wherein step of pumping the heat exchange fluid is by pumping of a mineral oil or pumping a glycol through the first, second and third heat exchangers.

14. The method of claim 1, further comprising the step of using a bypass line between the first heat exchanger and the vessel.

15. The method of claim 1, further comprising the step of using a control panel, at least one sensor, and a central processing unit in communication with the control panel and sensor to monitor and compare the pressurized heat exchange fluid in to a preset value.

16. A method for retrofitting a power plant that reduces the consumption of fossil fuel using hot exhaust gas comprising:

a. retrofitting the power plant by adding at least three heat exchangers, a vessel, a pump, and a control system to the power plant wherein a first heat exchanger receives hot exhaust gas air from a power source and produces heated heat exchange fluid;

b. supplying heated heat exchange fluid to a second heat exchanger that heats a hydrocarbon flow for the power plant that drives a turbine coupled to a generator and produces power and additional hot exhaust gases;

c. pumping a heat exchange fluid through a first heat exchanger around a first set of tubes containing the hot exhaust gas in the first set of tubes forming heated heat exchange fluid;

d. removing cooled exhaust gas from the first set of tubes in the first heat exchanger;

e. removing the heated heat exchange fluid from the first heat exchanger, passing at least a first portion of the heated heat exchange fluid to a second heat exchanger and a second portion of the heated heat exchange fluid from the first heat exchanger to a vessel;

f. injecting a hydrocarbon flow into a second set of tubes in the second heat exchanger and flowing the heated heat exchange fluid into the second heat exchanger around the second set of tubes transferring heat from the heated heat exchange fluid to the hydrocarbon flow forming a heated hydrocarbon flow and a cooled heat exchange fluid, and wherein the second heat exchanger increases the hydrocarbon flow temperature between 50% and 900%, and then discharging the heated hydrocarbon flow to a hydrocarbon flow outlet, and flowing the cooled heat exchange fluid to the vessel;

g. using the vessel to accommodate thermal expansion of the fluid from the first heat exchanger, the second heat exchanger, or combinations thereof;

h. passing at least a portion of the heat exchange fluid from the vessel to a third heat exchanger and from the third heat exchanger to a pump; and i. pumping the cooled heat exchange fluid from the vessel to the first heat exchanger, wherein at least a portion of the cooled heat exchanger fluid passing from the vessel to the first heat exchanger flows through a conduit and back to the vessel.

17. The method of claim 16, wherein the turbine is a gas turbine, or a combustion turbine.

18. The method of claim 16, wherein the power source is a turbine, a turbine rotor, a compressor, a main exhaust stack of the power source, or combinations thereof.

19. The method of claim 16, wherein the hot exhaust gas is injected at a pressure between 80 psia and 300 psia.

20. The method of claim 19, wherein the hot exhaust gas is injected at a pressure between 89 psia and 270 psia.

21. The method of claim 16, wherein the compressed cool air is removed from the first heat exchanger at a pressure between 80 psia and 300 psia.

22. The method of claim 16, wherein the cooling in the first heat exchanger occurs at a temperature between 300 degrees F. and 500 degrees F.

23. The method of claim 16, comprising the step of using a fin/fan heat exchanger as the third heat exchanger.

24. The method of claim 16, wherein the cooling in the third heat exchanger is by a fan that cools the pressurized heat exchange fluid by up to 95%.

25. The method of claim 16, wherein the step of flowing the hydrocarbon flow is by flowing a member consisting of the group oil, natural gas, methane, propane, and combinations thereof.

26. The method of claim 25, further wherein step of flowing the hydrocarbon flow is at a rate between 10 ft/lbs per second and 40 ft/lbs per second.

27. The method of claim 16, wherein the step of using a vessel involves using a vessel adapted to sustain a pressured heat exchange fluid between 15 psia and 300 psia.

28. The method of claim 16, wherein step of pumping the heat exchange fluid is by pumping of a mineral oil or pumping a glycol through the first, second and third heat exchangers.

29. The method of claim 16, further comprising the step of using a bypass line between the first heat exchanger and the vessel.

30. The method of claim 16, further comprising the step of using a control panel, at least one sensor, and a central processing unit in communication with the control panel and sensor to monitor and compare the pressurized heat exchange fluid in to a preset value.

* * * * *